United States Patent [19]

Justice

[11] Patent Number: 4,485,662

[45] Date of Patent: Dec. 4, 1984

[54] SUSPENSION STRUT ADJUSTING TOOL

[76] Inventor: Voyd H. Justice, 1295 New Hope Rd., Lawrenceville, Ga. 30245

[21] Appl. No.: 439,348

[22] Filed: Nov. 4, 1982

[51] Int. Cl.[3] ..... B21D 1/12

[52] U.S. Cl. ..... 72/380; 72/704; 72/701

[58] Field of Search ..... 72/292, 380, 384, 386, 72/387, 704, 705, 701

[56] References Cited

U.S. PATENT DOCUMENTS

| | | | |
|---|---|---|---|
| 1,869,905 | 8/1932 | Marsh et al. . | |
| 2,010,713 | 8/1935 | Countryman | 72/705 |
| 2,134,501 | 10/1938 | Bennett | 72/704 |
| 2,142,850 | 1/1939 | Johnston | 72/704 |
| 2,222,910 | 11/1940 | Lucker | 72/292 |
| 2,256,231 | 9/1941 | Bender | 72/704 |
| 2,427,536 | 9/1947 | Simons | 72/704 |
| 2,664,063 | 12/1953 | Makruski | 72/705 |
| 3,481,176 | 12/1969 | Horn | 72/386 |
| 3,765,219 | 10/1973 | Easom, Jr. | 72/389 |
| 4,103,531 | 8/1978 | O'Daniel | 72/704 |
| 4,117,709 | 10/1978 | Jackson | 72/386 |
| 4,388,820 | 6/1983 | Rickbeil | 72/704 |
| 4,424,697 | 1/1984 | Carver | 72/704 |

OTHER PUBLICATIONS

Brochure captioned "Specialty Products Company". Cover and p. 17 from advertising catalog captioned "Doug Duggan, Inc.".

*Primary Examiner*—Lowell A. Larson
*Attorney, Agent, or Firm*—Kilpatrick & Cody

[57] ABSTRACT

A tool is disclosed for adjusting the suspension struts in vehicles, in order to correct wheel camber. A web is bolted to the lug bolts corresponding to the strut being adjusted. A first hydraulically actuated ram is connected to the web and to a portion of the strut, while a second such ram, which pushes in a direction opposite to the first, is connected to a chain which is in turn connected to another portion of the strut. The operator applies hydraulic pressure to the rams, which push and pull on the strut until a predetermined deflection is achieved. Because the rams act on the web in directions opposite to each other, and in approximately the same plane, the forces acting on the web are substantially cancelled, and little force is thereby placed on the lug bolts of the vehicle, which might otherwise deform or destroy the wheel bearings.

11 Claims, 4 Drawing Figures

SUSPENSION STRUT ADJUSTING TOOL

BACKGROUND OF THE INVENTION

This invention relates to a tool which is used to adjust the front wheel camber of front-wheel drive vehicles having suspension systems which employ suspension struts of the type commonly known as "McPherson struts." Because such vehicles have no transmission hump and therefore may devote more space to passengers, and because these vehicles are lighter and more fuel efficient, they are becoming more prevalent. McPherson strut suspension systems are typically used because of the relative simplicity of such systems, and because they provide room and flexibility to accommodate the large constant-velocity joints used to transmit power from the engine to the front wheel.

McPherson strut suspension systems typically comprise a lower control arm to which the lower part of the wheel hub is rotatably attached by means of a ball joint. The upper part of the wheel hub forms the lower portion of the McPherson strut. The upper end of the McPherson strut accepts the weight of the vehicle, and a combination of a spring and a shock absorber in the upper part of the strut dampens the motion of the system to provide a smooth ride. When subjected to an excessive load, however, such as may be caused by a pothole or a curb, the strut tends to bend. In some cases, where the bend is permanent, and means must be provided to straighten or correct the bend in the strut to bring the front-end suspension system back into alignment; otherwise, strut replacement is required.

Such a means has heretofore been provided for vehicles having conventional rear wheel drive systems. In these vehicles, the McPherson strut in the front-end suspension extends nearly to the ball joint, the upper and lower portions of the wheel hub being in close proximity because no constant velocity joint is required. In these vehicles, it is possible to affix to the lug bolts of the wheel (which is supported by the wheel bearings) a tool which has at its upper end an hydraulic ram which may push or pull against the fairly long McPherson strut to bend it and thereby adjust the camber of the wheel.

In vehicles having front-wheel drive, however, the upper and lower portions of the wheel hub must be farther apart to accommodate the constant-velocity joint which transmits power from the engine to the wheel. This constant-velocity joint occupies the space where the lower portion of the McPherson strut would be in a conventional drive vehicle; therefore, in front-wheel drive vehicles, the McPherson struts must be shorter that those in vehicles having rear wheel drive. Because such struts are shorter, more force is needed to bend them for adjustment purposes than in rear-wheel drive vehicles; such force in front-wheel drive vehicles is so great that the tool mentioned above which is adequate for bending McPherson struts in rear-wheel drive vehicles by directing this force directly against the lug bolts, can ruin the wheel bearings in front-wheel drive vehicles.

SUMMARY OF THE INVENTION

The tool of the present invention comprises in part a web bolted to the lug bolts corresponding to the wheel being aligned after the wheel has been removed. The web provides a vertical platform to which a hydraulic ram is attached for pushing against the McPherson strut. Unlike earlier strut adjusting tools, however, the present invention also provides a second hydraulic ram for counteracting the forces applied by the first, in order to prevent undue force or torque from being applied to the lug bolts and wheel bearings by the first hydraulic ram. The second ram applies force in a direction opposite to the first, thereby pulling a chain which is wrapped around the McPherson strut above or below the point at which the first hydraulic ram is connected to the strut. Because the chain passes through the web in approximately the same plane as that in which the first ram is positioned against the web, the pushing and pulling forces of the two rams acting on the strut approximately cancel each other out, and large forces may be applied to the strut for alignment purposes, while only minor torque is applied to the web. As a result, only minor force or torque is applied to the lug bolts and wheel bearings.

It is therefore an object of the present invention to provide a device which allows adjustment of McPherson struts in front-wheel drive vehicles.

It is also an object of the present invention to provide a device which allows adjustment of McPherson struts in vehicles without placing undue force or torque on the wheel bearings of the suspension system being aligned.

A further object of the present invention is to provide a device which allows adjustment of McPherson struts in vehicles without the need to disassemble the suspension systems of the vehicles.

Yet another object of the present invention is to provide a relatively small, simple, low-cost device which may be easily transported, but which allows fast, accurate and effective alignment of McPherson strut suspension systems in vehicles having front-wheel drive systems.

Other objects and advantages of the present invention will become apparent during the course of the following description.

DETAILED DESCRIPTION OF THE DRAWINGS

Figure 1:
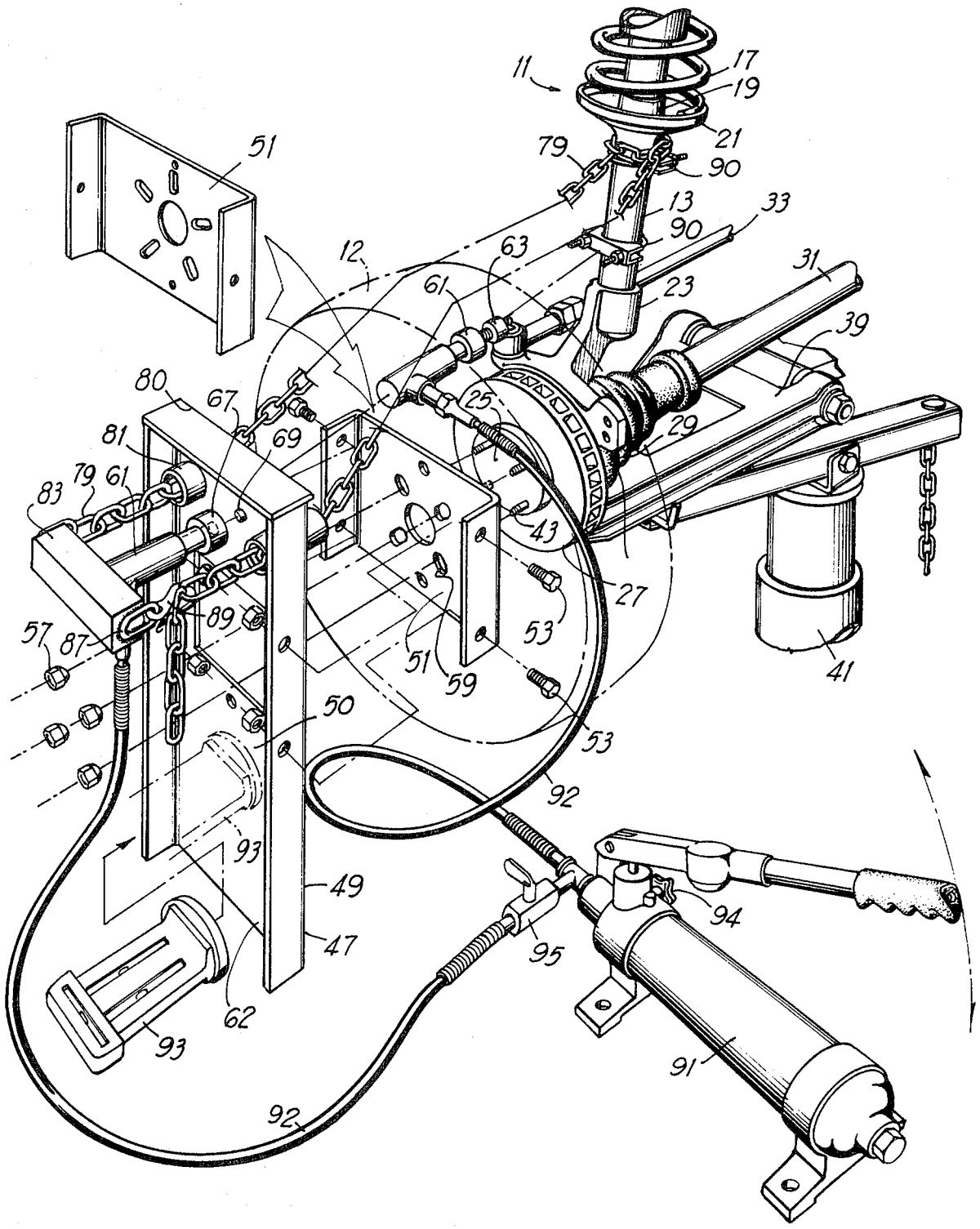
FIG. 1 is an exploded perspective view of the present invention, together with portions of a front wheel drive front end suspension system, arranged to apply negative camber to the wheel of the system being aligned.
Figure 2:
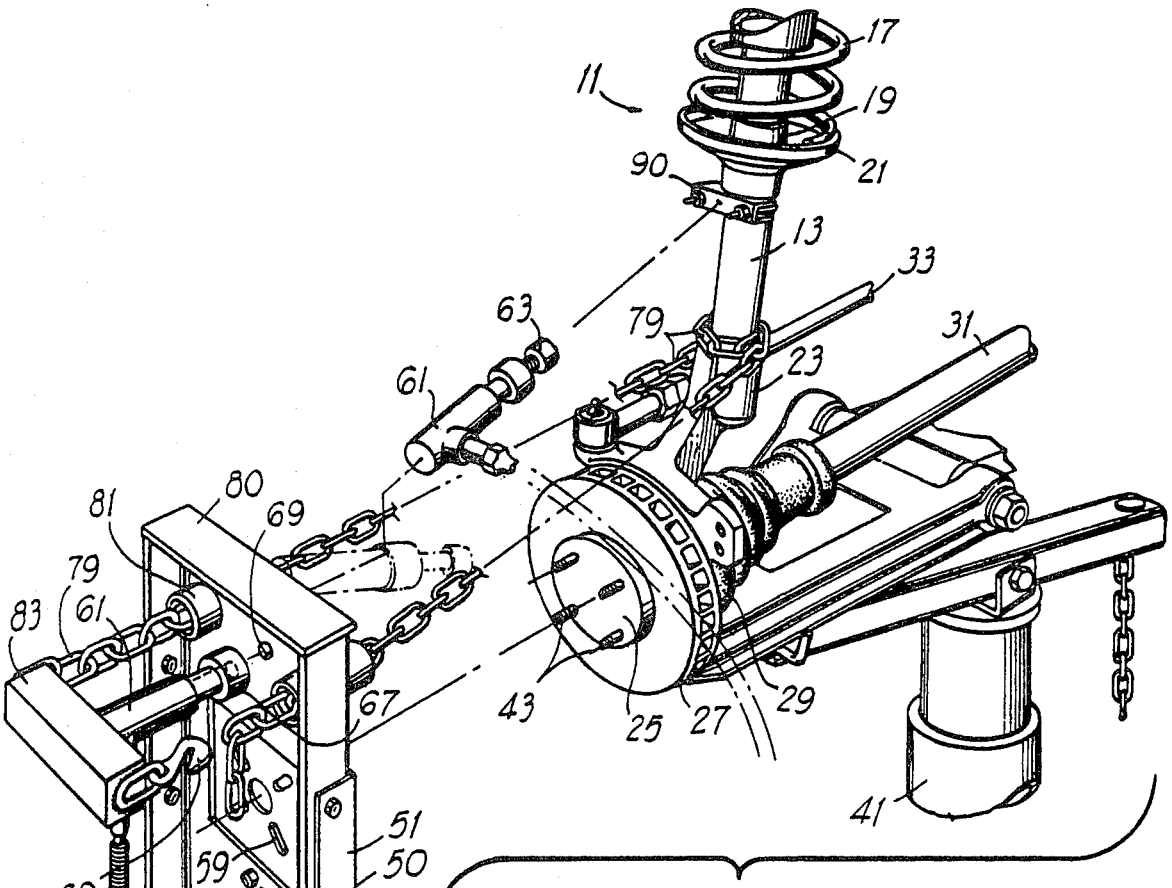
FIG. 2 is an exploded perspective view of the present invention, together with portions of a front wheel drive front end suspension system, arranged to apply positive camber to the wheel of the system being aligned.
Figure 3:
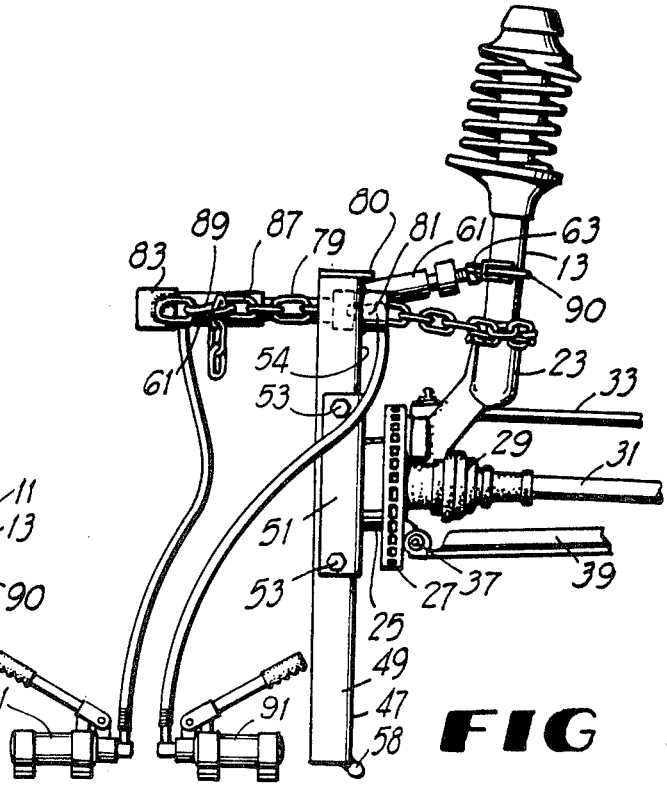
FIG. 3 is a side elevational view of the present invention arranged similar to FIG. 2, to apply positive camber to the wheel of the system being aligned.

FIGS. 1 through 3 show the tool of the present invention as it is arranged to adjust the front-end suspension system 11 of a vehicle having front-wheel drive. Suspension system 11 supports wheel 12 which is shown in dotted lines in FIG. 1. In suspension system 11, a tubular McPherson strut 13 serves as the upper suspension link between the wheel 12 and the body of the vehicle. A suspension coil spring 17 rests on a flange 21 which is typically welded to the McPherson strut 13, and the shock absorber 19 is located in the center of the coil spring 17 and the McPherson strut 13. A hub 23 forms the lower end of McPherson strut 13, in which stub axle 24 is rotatably mounted by means of wheel bearings (not depicted). Brake disc 27 is rigidly attached to axle stub 25 on its outer portion, and a portion of the constant velocity joint 29 is rigidly attached to the inner portion of stub axle 25. Constant velocity joint 29 connects axle shaft 31 to stub axle 25 in such a manner that stub axle 25 and wheel 12 may articulate throughout the range of rotation necessitated in steering the vehicle, and the range of up and down as well as backward and forward movement relative to the vehicle imparted on the wheel 12 by the driving surface, while at the same time being driven by axle shaft 31. Steering rod 33 connected to hub 23 imparts steering forces on hub 23. The lower portion of hub 23 is rotatably mounted by means of ball joint 37, as shown in FIG. 3, to lower control arm 39. In addition to providing support for hub 23, lower control arm 39 provides longitudinal stability for suspension system 11 by preventing wheel 12 from moving backward and forward relative to the vehicle.

While this type of suspension system is advantageous for front-wheel drive vehicles because it allows room for constant velocity joint 29 which is necessitated in such vehicles, the McPherson strut 13 may be bent or deformed when subjected to an overly large force, such as that caused by the vehicle traveling over a curb, a pothole, or other gross irregularity in the roadway or driving surface. In such an instance, wheel 12 imparts a twisting as well as a compressive force on hub 23, which is typically transmitted to the lower portion of McPherson strut 13, causing a deformity in McPherson strut 13. Such a deformity may cause the wheel 12 to have positive camber, in which case the top of the wheel 12 will be tilted outwardly from the vehicle, or negative camber, in which case the top of the wheel 12 will be tilted inwardly toward the vehicle.

The tool of the present invention is used in conjunction with a conventional alignment pit and a vehicle jack 41 as shown in FIG. 1. The wheel 12 is unbolted and removed from lug bolts 43 after the vehicle has been lifted by jack 41. The tool of the present invention may then be used to adjust the suspension system 11 of the vehicle. As a preliminary step in this process, web 47, comprising primary web plate 49 and adapter plate 51, is attached to lug bolts 43. Since the configurations of lug bolts on the vehicles with which the tool of the present invention may be used vary as to number, spacing and size, this tool employs a plurality of adapter plates 51, each of which is fabricated to receive certain configurations of lug bolts 43 in lug bolt holes 59. The appropriate adapter plate 51 for the suspension system 11 being adjusted is selected and attached to primary web plate 49 by means of fasteners 53. The front side 54 of web 47 is then bolted to lug bolts 43 by means of lug nuts 57. Primary web plate 49 and adapter plate 51 may be constructed of any high-strength metal, and although shown in FIG. 1 as being fabricated in channel form, they may also take the form of an I-beam, a flat plate, or any other shape lending itself to the appropriate size, strength and expense parameters. A rod 58 or other base may be attached to the bottom of primary web plate 49 to allow it to rotate freely while resting on a surface, as illustrated in FIGS. 2 and 3.

As a next step in the adjustment process, as shown in FIGS. 1 and 2, hydraulically actuated rams 61 are connected to web 47 and to McPherson strut 13. Rams 61 may be of the type which are commercially available and may be of any suitable size and able to receive attachments for extending their length and for allowing them to grip McPherson strut 13. In the depicted embodiment, each ram 61 has an adjustable extender 63 which allows the length of ram 61 to be shortened or lengthened as the adjustable extender 63 is screwed in or out. The end surface of each adjustable extender 63 is knurled, corrugated or otherwise roughened. The adjustable extender 63 of each ram 61 may be removed, by unscrewing it from the piston end of ram 61, leaving a cavity 67 for receiving stud 69 which protrudes from the back side 62 of primary web plate 49 to hold ram 61 in place. The surface forming the opposite non-piston end of ram 61 is a flat surface. One such ram 61 having adjustable extender 63 removed is positioned on stud 69 on the back side 62 of primary web plate 49. It is then connected to chain 79 which has been wrapped around the McPherson strut 13 and passed through reinforced openings 81 in primary web plate 49 by means of adapter block 83, which rests against the flat end of ram 61, and to which chain 79 is attached. Chain 79 and adapter block 83 may be of any material having appropriate strength, size and elasticity parameters; in the depicted embodiment, chain 79 is of case hardened steel, and is adjustably attached to adapter block 83 by means of connecting the appropriate chain link 87 to hook 89 which is attached to the adapter block 83.

Another ram 61 is positioned on the front side 54 of primary web plate 49, its flat end resting thereon, and its adjustable extender 63 with knurled end connected to McPherson strut 13. The flat end of forward ram 61 may be positioned in any suitable configuration against web 47, including against primary web plate 49, against upper lip 80 of primary web plate 49, or against primary web plate 49 and the edge of adapter plate 51.

As shown in FIGS. 1 through 4, forward ram 61 and chain 79 may be held in place on McPherson strut 13 by means of holding devices 90, which are muffler clamps in the depicted embodiment. These holding devices 90 prevent ram 61 or chain 79 from sliding along the surface of McPherson strut 13, and from placing too concentrated a force on McPherson strut 13 thereby deforming it unacceptably, as the adjusting process is undertaken; indeed, the knurled end of adjustable tip 63 of the forward ram 61 may be positioned directly against one of these holding devices 90 rather than on strut 13.

Rams 61 are actuated by actuating means 91 which may be a hand pump or other pump capable of providing the requisite hydraulic pressure needed to actuate rams 61. In the depicted embodiment, actuating means 91 is a hydraulic hand pump, which is commercially available and provides up to approximately 4 tons of hydraulic pressure. Actuating means 91 is connected to rams 61 by means of hydraulic lines 92 which may also be of a type that are commercially available. In the depicted embodiment, one actuating means 91 provides pressure to both hyraulic rams 61; however, in some instances, it may be desirable to actuate each ram 61 by means of its own actuating means 91.

To assist in determining the deflection that has been applied to McPherson strut 13 to correct the camber of wheel 12, measuring means in the form of an alignment gauge 93 may be attached to web 47 on accomodation 50. Accomodation 50 may be at any location on primary web plate 49 or adapter plate 51, which is of appropriate size and orientation to accomodate alignment gauge 93. This alignment gauge 93 allows the operator to easily determine how much pressure should be provided by actuating means 91 to properly adjust McPherson strut 13.

Once the tool of the present invention is in place, the operator applies pressure to rams 61 which push and pull on McPherson strut 13. The operator applies pressure until the alignment gauge 93 indicates the desired reading; then, pressure is released by means of pressure release 94 on actuating means 91, and the alignment gauge 93 is again inspected to determine the actual resulting deflection of McPherson strut 13 caused by pushing and pulling it with the tool of the present invention. This process is repeated until the desired camber of the wheel is achieved as indicated on alignment gauge 93.

FIG. 1 shows the tool of the present invention arranged to provide negative camber (the top of wheel 12 tilting towards the vehicle) while FIG. 2 depicts the tool arranged to provide positive camber. These figures illustrate that ram 61 and pulling means 79 may be placed in a variety of positions along the length of McPherson strut 13, giving the operator a high degree of flexibility in using the tool of the present invention to adjust McPherson strut 13.

FIG. 3 illustrates the important advantage of the tool of the present invention in not placing undue torque on lug bolts 43 and therefore on the bearings which support wheel 12. The ram 61 located on the forward portion of primary web plate 49 is attached to primary web plate 49 approximately co-planar with chain 79 as it exits primary web plate 49 through reinforced openings 81. Since the pushing and pulling forces of the two hydraulic rams 61 approximately cancel each other, little resultant force is placed on primary web plate 49 and on lug bolts 43.

Figure 4:
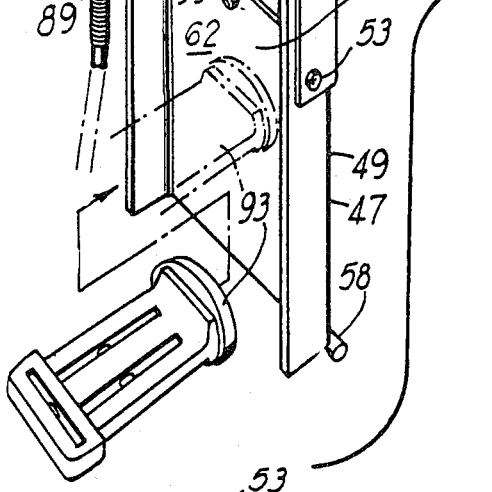
FIG. 4 is a plan view of the present invention arranged, similar to FIG. 2, to apply positive camber to the wheel of the system being aligned.
Figure 4:
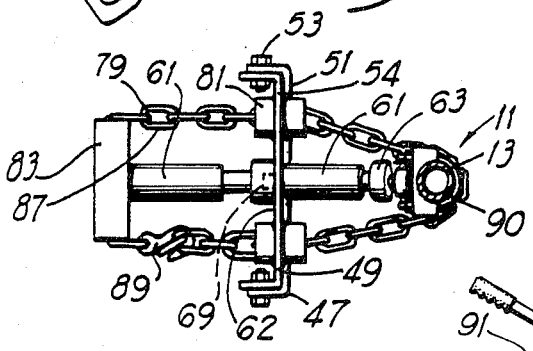

FIG. 4 is a plan view of the tool of the present invention attached to McPherson strut 13 showing arrangement of primary web plate 49, adapter plate 51, rams 61 and chain 79.

The tool of the present invention may also be used with only one ram 61 in instances where there is no danger of ruining the wheel bearings of the suspension system 11 being adjusted. The ram 61 may be positioned on the front part of primary web plate 49 and connected to McPherson strut 13 to provide positive camber, or it may be positioned on the rear portion of primary web plate 49 and used in conjunction with chain 79 to impart negative camber on wheel 12. In such cases, where only one ram 61 is used for the tool of the present invention, valve 95 located in one of hydraulic lines 92 may be positioned to isolate the other ram 61 from actuating means 91.

The foregoing description of the present invention is for purposes of explanation and illustration. It will be apparent to those skilled in the relevant art that modifications and changes may be made to the invention as thus described without departing from the scope and spirit thereof.

I claim:

1. A tool for adjusting the suspension struts in the front suspension system of a vehicle comprising:

(a) a web which may be bolted to the lug bolts of the wheel of the system to be adjusted;

(b) a first hydraulically actuated ram connected to the web and to a suspension strut of the system to be adjusted, for pushing the portion of the suspension strut to which it is connected away from the web;

(c) a second hydraulically actuated ram;

(d) a chain connected to the second hydraulically actuated ram and to the suspension strut, and exiting the web at approximately the same distance from the lug bolts as the distance the point at which the first ram is connected to the web is from the lug bolts, for pulling the portion of the suspension strut to which it is connected toward the web while opposing the forces on the web caused by the first ram;

(e) means for hydraulically actuating the first and second hydraulically actuated rams; and (f) an accommodation for accepting a measuring means attached to the web for determining the amount of adjustment of the suspension system.

2. A tool according to claim 1 wherein said web comprises:

(a) a primary web plate forming a portion of the web to which said first and second hydraulically actuated rams are connected; and (b) at least one adapter plate, which may be removably attached to the primary web plate to receive and be bolted to said lug bolts.

3. A tool according to claim 1 wherein said actuating means comprises a single pump for actuating said first and second hydraulically actuated rams.

4. A tool according to claim 1 wherein said actuating means further comprises an independent pump for actuating said first hydraulically actuated ram, and an independent pump for actuating said second hydraulically actuated ram.

5. A tool according to claim 3 wherein said first and second hydraulically actuated ram are hydraulically connected to said actuating means via a valve which may be positioned to isolate either of the hydraulically actuated rams from the actuating means.

6. A tool according to claim 3 wherein said second hydraulically actuated ram is hydraulically connected to said actuating means via a valve which may be positioned to isolate the second hydraulically actuated ram from the actuating means.

7. A tool for adjusting the suspension struts in the front suspension system of a vehicle, comprising:

(a) a web having:

(i) a primary web plate; and (ii) at least one adapter plate which may be removably attached to the primary web plate to receive and be bolted to lug bolts of the system to be adjusted;

(b) a first hydraulically actuated ram connected to the primary web plate and to a suspension strut of the system to be adjusted, for pushing the portion of the suspension strut to which it is connected away from the primary web plate;

(c) a second hydraulically actuated ram;

(d) a chain connected to the second hydraulically actuated ram and to the suspension strut and exiting the web plate at approximately the same distance from the lug bolts as the distance the point at which the first ram is connected to the web plate is from the lug bolts, for pulling the portion of the suspension strut to which it is connected toward the primary web plate while opposing the forces on the web plate caused by the first ram;

(e) means for hydraulically actuating the first and second hydraulically actuated rams;

(f) a valve for controlling the actuation of the second hydraulically actuated ram by the actuating means; and (g) an accommodation for accepting a measuring means attached to the web for determining the amount of adjustment of the suspension system.

8. A tool according to claim 7 wherein said web has a stud attached to at least one side, which may be snugly received by a cavity in the piston end of one of said hydraulically actuated rams.

9. A tool for adjusting the suspension struts in the front suspension system of a vehicle, comprising:

(a) a web having:

(i) a primary web plate;

(ii) a stud attached to at least one side of the primary web plate; and (iii) at least one adapter plate which may be removably attached to the primary web plate to receive and be bolted to lug bolts of the system to be adjusted;

(b) a first hydraulically actuated ram whose non-piston end is placed against the primary web plate and whose piston end has a threaded cavity;

(c) an extender having a roughened end and which may be screwed into the cavity;

(d) a first muffler clamp attached to the suspension strut of the system to be adjusted, against which the roughened end of the extender of the first hydraulically actuated ram is positioned;

(e) a second hydraulically actuated ram whose piston end has a cavity which receives the stud on the primary web plate;

(f) a chain adjustably connected to the non-piston end of the second hydraulically actuated ram and wrapped about the suspension strut and exiting the web plate at approximately the same distance from the lug bolts as the distance the point at which the first ram is connected to the web plate is from the lug bolts;

(g) a second muffler clamp attached to the suspension strut for holding the chain in place;

(h) means for hydraulically actuating the first and second hydraulically actuated rams;

(i) a valve which may be positioned to hydraulically isolate the actuating means from the second hydraulically actuated ram; and (j) a measuring means attached to the web for determining the amount of adjustment of the suspension system.

10. A method of adjusting a suspension strut in the front suspension system of a vehicle comprising the steps of mounting a web to the lug bolts corresponding to the strut being adjusted, applying from a first point on the web a first force to a first portion of the strut and applying from a second point on the web located approximately the same distance and direction from the lug bolts as the first point a second force, of substantially equivalent magnitude in substantially the opposite direction as the first force, to a second portion of the strut in such a manner that the appropriate camber is imparted to the wheel, the first and second forces substantially cancel each other, and the resulting force transmitted to the wheel bearings is insufficient to deform or damage the wheel bearings.

11. A method of adjusting a suspension strut in the front suspension system of a vehicle comprising the steps of:

(a) removing the wheel corresponding to the suspension strut to be adjusted;

(b) bolting a web to the lug bolts corresponding to the suspension strut;

(c) connecting a first hydraulically actuated ram to the web;

(d) connecting the first hydraulically actuated ram to the suspension strut;

(e) connecting a chain to the suspension strut at a point spaced apart from that at which the first ram is connected to the strut and passing the chain through the web so that the chain penetrates the web at approximately the same distance from the lug bolts as the distance the point at which the first ram is connected to the web is from the lug bolts;

(f) connecting a second hydraulically actuated ram to the chain and to the web;

(g) attaching a measuring means to the web;

(h) hydraulically actuating the first and second hydraulically actuated rams until a desired reading is indicated on the measuring means;

(i) releasing hydraulic actuation from the first and second hydraulically actuated rams;

(j) noting the reading on the measuring means; and (k) repeating steps (h) through (j) hereof until a desired reading is indicated on the measuring means.

* * * * *